US011051619B2

(12) United States Patent
Smiley

(10) Patent No.: US 11,051,619 B2
(45) Date of Patent: Jul. 6, 2021

(54) CUSHIONED OUTDOOR OVAL FURNITURE PIECE THAT CAN SWIVEL ON A STAND WITH A TINTED LID

(71) Applicant: Hosam Khalil Smiley, Brooklyn, NY (US)

(72) Inventor: Hosam Khalil Smiley, Brooklyn, NY (US)

( * ) Notice: Subject to any disclaimer, the term of this patent is extended or adjusted under 35 U.S.C. 154(b) by 97 days.

(21) Appl. No.: 15/942,564

(22) Filed: Apr. 1, 2018

(65) Prior Publication Data

US 2019/0298065 A1 Oct. 3, 2019

(51) Int. Cl.
*A47C 3/12* (2006.01)
*A47C 1/14* (2006.01)
*A47C 3/18* (2006.01)

(52) U.S. Cl.
CPC ..... *A47C 3/12* (2013.01); *A47C 1/14* (2013.01); *A47C 3/18* (2013.01)

(58) Field of Classification Search
CPC ..... A47C 3/0255; A47C 17/84
See application file for complete search history.

(56) References Cited

U.S. PATENT DOCUMENTS

D249,408 S * 9/1978 Jackson ..... D6/347
4,314,727 A * 2/1982 Potts ..... A47C 7/66 297/184.12
D819,348 S * 6/2018 Hassman ..... D6/345
2015/0030790 A1* 1/2015 Duncan, III ..... E04H 15/04 428/34.1
2015/0335136 A1* 11/2015 Wehner ..... A45F 3/26 297/273

* cited by examiner

*Primary Examiner* — Sarah B McPartlin
(74) *Attorney, Agent, or Firm* — Hosam Smiley

(57) ABSTRACT

A cushioned, swiveling outdoor oval furniture piece on a stand with a tinted lid is disclosed. This invention improves on existing furniture pieces because the stand is a wider base attached from the top of the furniture piece wrapping around to the bottom allowing for a more stable stand on outdoor surfaces, is an oval ostrich egg shape allowing for up to two persons to sit, and has a tinted lid to cover the opening to protect the interior and person or persons sitting from normal weather conditions and sunlight with an option to swivel.

8 Claims, 4 Drawing Sheets

CUSHIONED OUTDOOR OVAL FURNITURE PIECE THAT CAN SWIVEL ON A STAND WITH A TINTED LID

BACKGROUND

Field of the Invention

This invention relates to a suspended piece of outdoor furniture, yet lightweight that can accommodate two individuals at same time. The invention more particularly is a structure, which has a zone geometry and is suspended through a suitable support to facilitate free movement of the structure.

Description of the Related Art

Any indoor hanging or outdoor hanging chair is an accessory which everyone wants to have at home for their enjoyment and to get relaxed. Some people like to put their hanging chairs on their balcony in the spring, and then move them back into the living room during the winter, putting them next to a huge window or in front of the fireplace. However, no matter how lightweight they are, taking it indoors or covering it with a furniture cover every time you notice the clouds turn gray becomes a bit of a nuisance.

Either people love to have a big swing on the porch or in the garden and some prefer a few beautifully designed outdoor swing chairs as this fashionable piece of furniture doesn't require much space and is just perfect for garden, poolside or balcony.

Looking at their evergreen requirements and the interest of people toward this piece of furniture, multiple types of product in this domain are available. For instance, according to U.S. Pat. No. 6,912,744 issued to Beaumont Gregory Lyons is a suspended furniture assembly, which includes a suspended chair assembly and a suspended hammock assembly. The suspended chair assembly comprises a chair including a back support, a bottom support and arm support members, suspended from a chair suspension frame assembly by suspension elements, the chair suspension frame assembly including opposed laterally spaced horizontally extending front and rear base frame members, an upstanding frame member at each side of respective base frame members, and laterally extending vertically spaced upper and lower frame members and connecting opposed front and rear upstanding members on respective assembly sides. The chair is suspended on respective sides from the chair suspension frame assembly by suspension elements connected to the lateral frame members. The suspended hammock assembly comprises a frame assembly having a base frame comprising a first longitudinal frame member and parallel thereto, a frame member, a hammock strung between hammock support elements.

For instance, a U.S. Pat. No. 6,418,577 issued to Michael Murphy is a portable hammock designed to be used between any two rigid structures includes leg standards removably attached to opposite ends of a flexible hammock material with said leg standards removably attached to the two rigid structures. Loops of material connected to opposite ends of the flexible hammock material encase a portion of a strap rod. A system of flexible straps and hooks connect the leg standards to the flexible hammock material and the rigid structures. Two legs removably coupled to a rigid member form the leg standards. The legs and strap rods are in sections and the legs are easily removed from attachment with the rigid member permitting the portable hammock's size to be minimized during non-use. When disassembled, the portable hammock fits into a carrying bag no larger than a gym bag. In one embodiment, the portable hammock is erected between a tree and a motorcycle.

Similarly a U.S. Pat. No. 7,735,166 issued to Jack Weeks is a multi-functional hammock assembly for providing user comfort and enjoyment may include first and second elongated rectilinear poles, a hammock, and first and second sleeves slidably positioned about the bottom ends of the first and second poles. The hammock assembly may further include at least one accessory and a mechanism for effectively anchoring the at least one accessory to the first and second poles. The assembly may further include a mechanism for synchronously rotating at least one of the first and second sleeves and the first and second poles about a centrally registered longitudinal axis passing through the one pole to thereby conveniently assist a user to penetrate the one sleeve into a ground surface.

Another U.S. Pat. No. 7,040,995 issued to Benjamin Michael Lee is a, Hinging Chair Stand (100), a Hinging Chair Stand includes first and second support members (200 and 202) coupled to one another at the intermediate portion. (210) The support members each have a leg portion (206 a and 206 b) that is adapted to rest on a base and an arm portion (204 a and 204 b) adapted to suspend a hanging chair over a region defined by the leg portions 220. A pair of attachment members (212) may be coupled to ends of the arm portions to suspend the hanging chair over the region.

From the above research and study this has been found out that none of the inventions provide the improvement features as intended through this invention. This invention improves on existing furniture pieces because the stand is a wider base attached from the top of the chair wrapping around the oval frame to the bottom allowing for more stability on outdoor surfaces, is an oval ostrich egg shape allowing for two persons to sit, has a tinted lid to cover the opening to protect the interior and person or persons sitting from weather and sunlight and a swivel function.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY OF THE INVENTION

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

It is therefore the purpose of the invention to alleviate at least to some extent one or more of the aforementioned problems of the prior art and/or to provide the relevant public with a suitable alternative thereto having relative advantages.

The primary object of the invention is related to a hanging assembly which provides an improvement on conventional hammocks and hanging assemblies used for indoor and outdoor entertainment purposes.

It is further the objective of the present invention to provide a furniture piece which is egg shaped and is hanged with the stand which is wider than the traditional size allowing better stability and grip for the oval assembly.

It is further the objective of the invention to provide an assembly which is egg shaped and has capacity of two people to sit at a single point of time.

It is also the objective of the invention to provide a tinted lid to cover the opening to protect the interior and person or persons sitting from weather and sunlight and a swivel function.

It is further more the objective of the invention to provide user with aesthetic satisfaction by the beautiful and light weight design of the current assembly.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
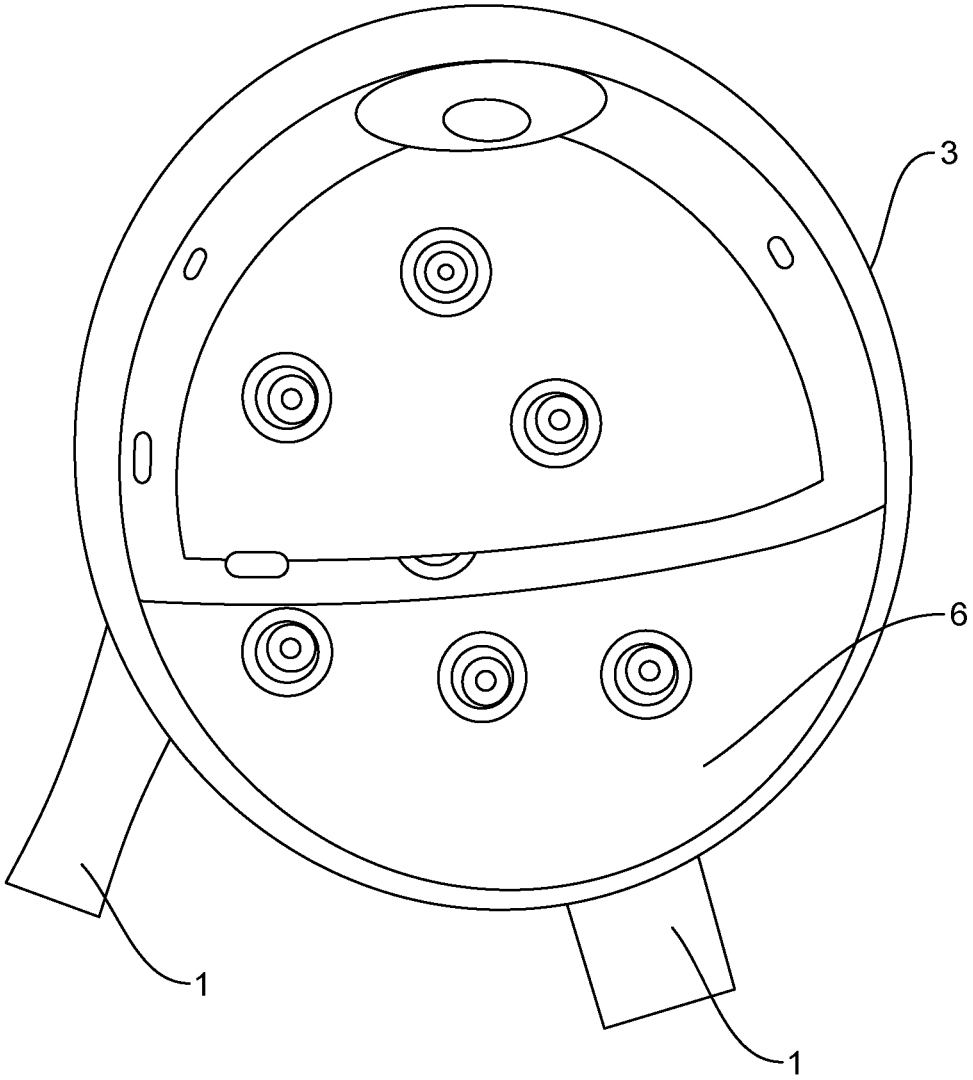
FIG. 1 is a Top Plan view of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

As stated above, there currently is not an option designed for two persons to sit in an oval furniture piece suspended on a frame designed to help protect from outdoor conditions and sunlight and is able to swivel. In the conventional oval furniture pieces and their limitation of not working well is because the furniture piece either rests on a base attached directly underneath the chair which makes is more susceptible to tipping under a slightly uneven surface, or is suspended from something overhead, which limits placement of the product. The furniture pieces are normally a chicken egg shaped oval which allows room for only one person as opposed to the ostrich egg loveseat design that has room for two. They do not have tinted lids to protect the interior from normal weather conditions and sunlight while being in use. The invention claimed here solves this problem.

This oval shaped furniture piece in its preferred embodiment is suspended on a stand and designed to help withstand weather and sunlight through the use of a retractable lid that covers the interior of the oval shaped furniture piece and has a wide base design and a swivel function.

The oval furniture piece in its further embodiment is different from and better than other oval furniture because the stand is easier to be used outside, suspends the oval frame for a more comfortable sitting experience, is capable of seating two persons. The invention in its additional embodiment provides a lid to protect the persons and cushioning inside the oval from weather and sunlight with an option for a swivel function. This invention will provide an improvement on what currently exists.

FIG. 1 illustrates a top plan view of the present invention consisting of two legs (1) and an oval frame (3). The oval furniture piece in its preferred embodiment consist of an oval frame (3) with a tinted lid (6).

Figure 2:
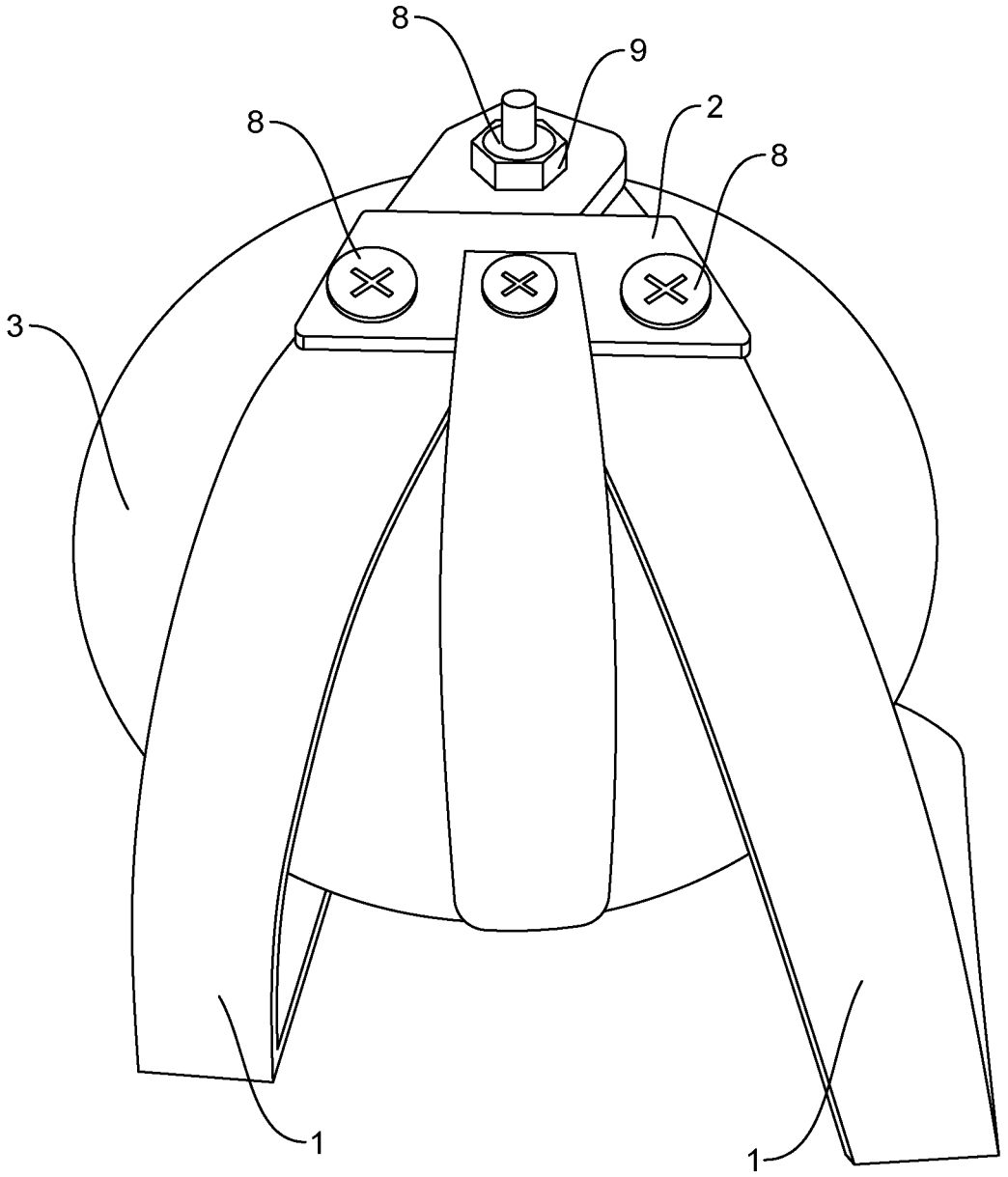
FIG. 2 is a view of the top portion of the present invention, where the anchoring part of the hanging furniture piece is connected to the fixed end of the frame.
Figure 3:
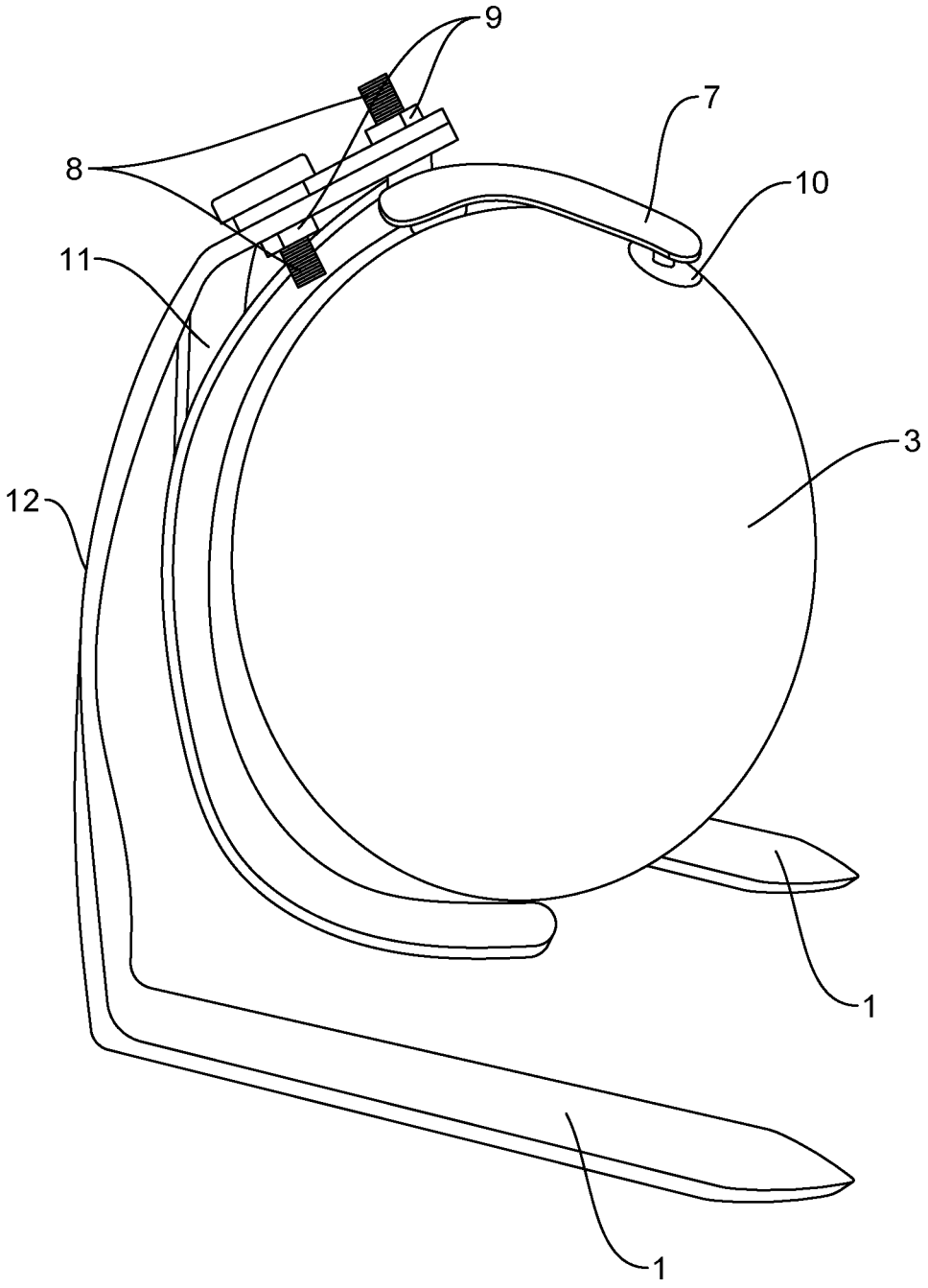
FIG. 3 is a close-up view of the cushioned outdoor oval furniture piece that can swivel on a stand with a tinted lid.
Figure 4:
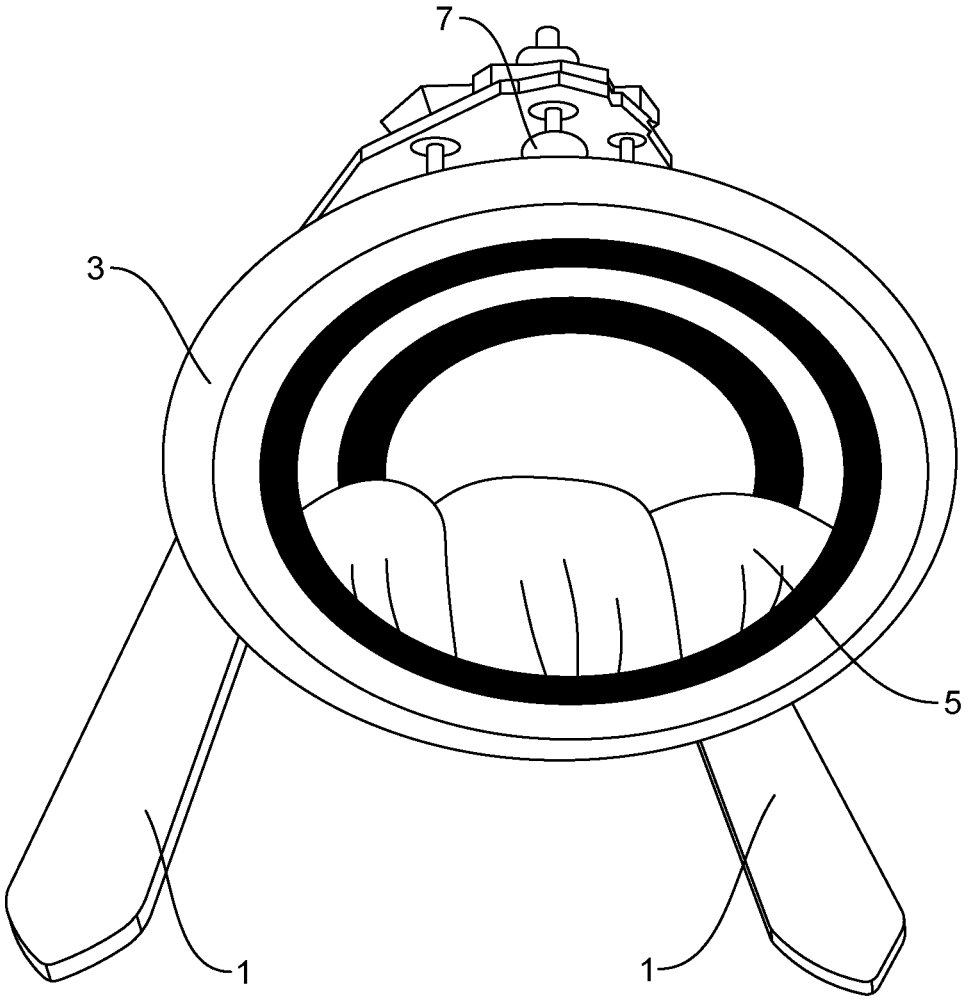
FIG. 4 is a front view of the present invention.

FIG. 2 illustrates a view of the top portion of the present invention, where the anchoring part of the hanging furniture piece is connected to the fixed end of the frame and FIG. 3 illustrates a close-up view of the cushioned outdoor oval furniture piece that can swivel on a stand with a tinted lid. In FIG. 2 and FIG. 3, a swivel support bar (11) can be attached to the screws (8) coming out of the top and bottom of the oval frame (3) and fastened by use of a nut (9) over and under the swivel bar on the top and bottom screw (8) securing it in place while a nut (9) rotates that is attached to the oval frame (3) onto the upper and lower screws (8) allowing tint swivel on the screws. Two swivel stopper rods (12) are attached to the oval frame (3) on each side of the swivel support bar (11). Two legs (1) are attached by a brace (2) connecting the two legs (1) together by 2 screws (8) and 2 nuts (9) creating a base and stand for the oval frame (3). The legs (1) are connected to the top of the oval frame (3) by use of the top screw (8) through a hole on the legs secured by a nut (9). Fasteners (10) are mounted inside the oval frame (3) where more fabric cushioning (5) is attached. Fabric covered cushioning (5) are attached to the fasteners (10). In FIG. 4, the two legs (1), the oval frame (3), fabric covered cushioning (5), and the elastic bands (7) are illustrated.

The stand is a support for the oval frame. The tinted lid protects the person or persons and interior from sunlight and undesirable weather conditions. The elastic band allows the removal and replacement of the tinted lid. The top and bottom screws allow for all four of these components, stand, oval frame, swivel support bar, and tinted lid attached to elastic bands to be connected together. The swivel support bar is secured to the upper and lower screws that are connected to the oval frame to allow the oval frame to swivel around the screws. The swiveling is stopped by two rods positioned on both sides of the swivel support bar that will catch the furniture piece from spinning around. The molded interior allows for suitable sitting position inside the oval frame that has fabric covered cushions to allow more comfort.

To make this oval shaped furniture piece one will simply mold a frame in the shape of an ostrich egg large enough to fit two persons. A lid is cut off the mold allowing for an opening for the entrance and exit of user/users and creating the shape for the lid. The lid is set in a mold that is used to create a clear replica and is covered in tint. A seat shape, back piece and bench, is then molded on the interior of the frame. Fasteners are placed on the whole interior of the frame and fabric cushions and are connected to it. Swivel stopper rods are molded on the top on each side of where the swivel support rod is to be placed.

A screw is fixed to the top and bottom of the oval frame. The elastic bands are each connected to a nut that is then mounted onto the screws coming out of the oval frame. The lid is fastened to the elastic bands by fasteners and is now able to rotate on and off the opening of the frame. A bar is taken and bent to the curvature of the oval allowing for room of the elastic bands and lid to move freely where two holes are made on both sides. The bar is then mounted on the upper and lower screws resting on a nut and another nut is placed on top of the bar where it becomes tightened in place. Two holes are made at the top of the straight leg pieces and a bend in the legs are made at a curve that allows room for the oval shaped furniture piece, lid, and swivel support bar to be laid to rest without touching the legs. Then a second bend, roughly 90-degree angle, is made on the legs at the bottom to allow it to support the oval frame without tipping on the surface or touching the floor. After the two legs are connected to the top screw in the oval frame, the legs are moved out to the width of the oval frame and the brace is made accordingly to connect across the legs. The screw holes are made in the legs and brace and are connected by two screws and two nuts. The stand, oval frame, Fasteners, elastic band, and tinted lid, are all necessary elements of this invention. While the molded interior and fabric cushions are optional, it will create a lot of discomfort and is better off with it. The brace is optional if the legs are welded together and secured tightly to the screw. The lid can be permanently fastened to the elastic bands and installed and removed when a reverse thread screw is used on the bottom of the oval frame.

A swivel function can be added to the furniture piece by welding, use of a nut under and over the swivel support bar securely or other means of securing the swivel support bar to the upper and lower screws that the oval framed swivels on. The swivel function can be removed by taking out the swivel bar support and swivel and fixing the upper and lower screws to the oval frame. A tether can be placed on the inside of the lid that is then connected to the interior of the oval frame to allow easier placement of the lid. Screws and nuts on the brace can be substituted by other methods to be secured to the legs like welding or all thread and four nuts, etc. The oval frame can be set at a reclining position to a certain degree to allow for a more comfortable experience. On the other hand, placed at a 90-degree sitting angle. A swivel could be attached to the oval frame and screws connected to it to allow the whole furniture piece to swivel or it can be removed and made stationary.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A cushioned outdoor furniture piece comprising:

an oval frame with an opening;

a tinted lid covering the opening of the oval frame;

a first screw fixed to a top of the oval frame and a second screw fixed to a bottom of the oval frame;

a first elastic band mounted on the first screw and secured by a first nut;

a second elastic band mounted on the second screw and secured by a second nut;

wherein the tinted lid is fastened to the first elastic band by fasteners and is movable from a deployed position covering the opening to a retracted position away from the opening;

a support bar bent to a curvature of the oval frame and spaced apart from the oval frame;

two legs, wherein each leg has a straight leg piece for resting on a surface and a bent leg piece with a curvature extending upward from the straight leg piece;

a brace for connecting upper ends of each leg piece; and wherein the two legs are configured to form a base and stand for the oval frame, and wherein the first screw extends through the top of the oval frame, the elastic band, the support bar, the two legs, and the brace, the second screw extends through the bottom of the oval frame, the second elastic band, and the support bar, and the oval frame is configured to swivel with respect to the support bar and the two legs.

2. The cushioned outdoor oval furniture piece according to claim 1, wherein the tinted lid is present to cover the opening to protect an interior and persons sitting from normal weather conditions and sunlight.

3. The cushioned outdoor oval furniture piece according to claim 1, wherein the support bar has a first end secured to the first screw with a first nut and a second end secured to the second screw with a second nut.

4. The cushioned outdoor oval furniture piece according to claim 1, wherein a brace extends between the two legs and is attached to each of the legs with a screw and a nut.

5. The cushioned outdoor oval furniture piece according to claim 1, wherein in the furniture piece further comprises a molded interior and fabric cushions, and wherein the molded interior and fabric cushions are removable.

6. The cushioned outdoor oval furniture piece according to claim 1, wherein the lid is permanently fastened to the first elastic band and the second elastic band.

7. The cushioned outdoor oval furniture piece according to claim 1, wherein a swivel is attached to the oval frame so that the oval frame is configured to swivel with respect to the base and stand.

8. The cushioned outdoor oval furniture piece according to claim 1, wherein the legs are spaced apart by a width, wherein said width is equal to or greater than a diameter of the oval frame wherein said diameter is substantially parallel to a surface upon which the furniture piece is support, and wherein the brace is made to connect the legs.

* * * * *